US006826381B2

(12) United States Patent
Muramatsu et al.

(10) Patent No.: US 6,826,381 B2
(45) Date of Patent: Nov. 30, 2004

(54) IMAGE FORMATION DEVICE AND AGENT SUPPLYING DEVICE INCLUDING ABSORBER CONVEYING BY NEGATIVE PRESSURE

(75) Inventors: Satoshi Muramatsu, Tokyo (JP); Hideo Yoshizawa, Tokyo (JP); Hideki Kimura, Tokyo (JP); Kazuhisa Sudo, Tokyo (JP); Yoshio Hattori, Tokyo (JP); Junichi Matsumoto, Tokyo (JP)

(73) Assignee: Ricoh Company, LTD, Tokyo (JP)

( * ) Notice: Subject to any disclaimer, the term of this patent is extended or adjusted under 35 U.S.C. 154(b) by 0 days.

(21) Appl. No.: 10/329,356

(22) Filed: Dec. 27, 2002

(65) Prior Publication Data

US 2003/0235435 A1 Dec. 25, 2003

(30) Foreign Application Priority Data

Dec. 28, 2001 (JP) ..... 2001-400635
Dec. 28, 2001 (JP) ..... 2001-400636

(51) Int. Cl.[7] ..... G03G 15/08
(52) U.S. Cl. ..... 399/260; 399/258
(58) Field of Search ..... 399/119, 252, 399/258, 259, 260, 262, 263, 292

(56) References Cited

U.S. PATENT DOCUMENTS 5,953,567 A * 9/1999 Muramatsu et al. .... 399/258 X
6,067,431 A * 5/2000 Bakker ..... 399/252
6,163,669 A 12/2000 Aoki et al.
6,198,895 B1 3/2001 Tsuda et al.
6,201,941 B1 3/2001 Kasahara et al.
6,295,437 B1 9/2001 Hodoshima et al.
6,337,957 B1 1/2002 Tamaki et al.
6,393,241 B1 5/2002 Matsumoto et al.
6,501,913 B2 12/2002 Hattori et al.
6,507,720 B2 1/2003 Kabumoto et al.
6,522,855 B1 2/2003 Terai et al.
6,526,246 B2 2/2003 Iwata et al.

FOREIGN PATENT DOCUMENTS

JP 2000-47465 2/2000
JP 2000-98721 4/2000
JP 2000-351445 12/2000

OTHER PUBLICATIONS

U.S. patent application Ser. No. 10/329,356, Muramatsu et al., filed Dec. 27, 2002.
U.S. patent application Ser. No. 10/652,505, Murakami et al., filed Sep. 2, 2003.
U.S. patent application Ser. No. 10/660,620, Murakami et al., filed Sep. 12, 2003.
U.S. patent application Ser. No. 10/665,286, Sakai et al., filed Sep. 22, 2003.
U.S. patent application Ser. No. 10/666,250, Matsumoto et al., filed Sep. 22, 2003.
U.S. patent application Ser. No. 10/703,447, Yoshiyuki et al., filed Nov. 10, 2003.
U.S. patent application Ser. No. 10/665,825, Yoshizawa et al., filed Sep. 22, 2003.
U.S. patent application Ser. No. 10/726,665, Hattori, filed Dec. 4, 2003.

* cited by examiner

*Primary Examiner*—Sandra L. Brase
(74) *Attorney, Agent, or Firm*—Oblon, Spivak, McClelland, Maier & Neustadt, P.C.

(57) ABSTRACT

A toner container contains a powdery toner. A powder pump conveys the toner in the toner container to a substantially closed, certain location using negative pressure. A toner conveyance tube conveys the toner from the container to the powder pump. An air pump supplies air into the toner container. An on/off valve opens and closes the toner conveyance tube.

31 Claims, 9 Drawing Sheets

| | TONER CLOGGED IN CONVEYANCE PATH | |
|---|---|---|
| AIR SUPPLY TIME INTERVAL [TONER CONVEYED AMOUNT (G)] | TONER A | TONER B |
| 0.1 | × | × |
| 0.2 | × | △ |
| 0.3 | × | ○ |
| 0.5 | △ | ○ |
| 0.7 | ○ | ○ |
| 1 | ○ | – |
| 2 | ○ | – |

IMAGE FORMATION DEVICE AND AGENT SUPPLYING DEVICE INCLUDING ABSORBER CONVEYING BY NEGATIVE PRESSURE

BACKGROUND OF THE INVENTION

1) Field of the Invention

The present invention relates to an agent supplying device that supplies agents, such as toner, a mixture of toner and carrier, and carrier alone, to a certain location from a container that contains the agents. The present invention also relates to an image formation device, for example, an electrographic printer, facsimile or copier.

2) Description of the Related Art

A hard bottle type container is generally employed in the art as a container for use in an electrographic image formation device to contain dried agents, such as toner, carrier, and a mixture of toner and carrier (hereinafter referred to as "toner" generically). Such container may include an agitator inside serving as a unit that agitates and discharges toner. Alternatively, it may have a helical groove formed on the container wall for rotating the container to move and discharge internal toner. Another container includes no discharge mechanism and thus is required to supply toner manually.

Recently, as environmental issues are increasingly valued, it is required to recover and recycle the toner containers. The hard bottle toner container has many problems associated with its recovery and recycle possibility, however, because it elevates a transportation cost and is hard to clean for reuse.

In view of the recovery and recycle possibility, a soft type toner container composed of a flexible material and having a reductive volume may often be employed. The dried toner for electrography generally has a poor fluidity and a property to be aggregated easily. Therefore, the use of the soft toner container to contain the dried toner for electrography makes it very difficult to discharge the toner from the soft container. Because the container is soft and an agitator or a discharge mechanism is hardly attached thereto, even if such the discharge mechanism can be attached, it prevents the container from reducing its volume.

Japanese Patent Application Laid-Open No. 2000-47465 and Japanese Patent Application Laid-Open No.2000-98721 disclose technologies that can greatly relieve the problems associated with such the conventional image formation device. The toner supplement devices disclosed in these publications are configured to absorbingly discharge toner contained in a flexible container therefrom using an absorbing pressure (negative pressure) caused from an absorbing powder pump (single-axial eccentric screw pump). Therefore, the toner contained even in the flexible container can be supplied to a development device without any trouble. In addition, the container is flexible and accordingly it can be easily recovered with a low transportation cost.

In the toner supplement devices, air is supplied into the toner container to sufficiently agitate the toner contained therein to sustain the toner quality in a good condition advantageously.

In the toner supplement devices disclosed in the publications, if the air is supplied excessively, the air supplied in the toner container flows into an air conveyance tube and pushes the toner within the tube. If such phenomena frequently occur, the toner in the tube may be compacted to cause the so-called "clogged" toner that can not be conveyed through the powder pump. This problem can be easily caused in a single conduit type nozzle, in which a nozzle inserted into the toner container is communicated with an air path and a toner path, because the supplied air directly flows into the tube and pushes the toner therein.

SUMMARY OF THE INVENTION

The image formation device according to one aspect of the present invention is provided with an agent container that contains powdery agents; an absorber that conveys the agents contained in the agent container to a substantially-closed, certain location using negative pressure; an agent conveyance conduit that forms an agent conveyance path between the agent container and the absorber; an air supplier that supplies air into the agent container; and an open/close unit that opens and closes the agent conveyance conduit.

The image formation device according to another aspect of the present invention is provided with an agent container that contains powdery agents; an absorber that conveys the agents contained in the agent container to a substantially-closed, certain location using negative pressure; an agent conveyance conduit that forms an agent conveyance path between the agent container and the absorber; an air supplier that supplies air into the agent container; and a positive pressure generator that generates positive pressure in the agent conveyance conduit when the air supplier supplies the air.

The image formation device according to still another aspect of the present invention is provided with an agent container that contains toner; an absorber that conveys the toner contained in the agent container to a certain location using negative pressure; a substantially-closed, agent conveyance path between the agent container and the absorber; an air supplier that supplies air into the agent container; and a controller that controls operations of the air supplier and the absorber, the controller actuating the air supplier when it is determined that a toner supplement amount by the absorber reaches a certain amount. The certain amount M is equal to or greater than 0.5 g.

The image formation device according to still another aspect of the present invention is provided with an agent container that contains toner; an absorber that conveys the toner contained in the agent container to a certain location using negative pressure; a substantially-closed, agent conveyance path between the agent container and the absorber; an air supplier that supplies air into the agent container; and a controller that controls operations of the air supplier and the absorber, the controller actuating the air supplier when it is determined that a toner supplement amount by the absorber reaches a certain amount. The certain amount is equal to a value based on the toner contained in the agent container.

The image formation device according to still another aspect of the present invention is provided with an agent container that contains toner; an absorber that conveys the toner contained in the agent container to a certain location using negative pressure; a substantially-closed, agent conveyance path between the agent container and the absorber; an air supplier that supplies air into the agent container; and a controller that controls operations of the air supplier and the absorber, the controller actuating the air supplier when it is determined that a toner supplement amount by the absorber reaches a certain amount. If the certain amount is denoted with M, the controller varies the certain amount M based on the amount contained in the agent container.

The agent supplying device according to still another aspect of the present invention is provided with an agent container that contains powdery agents; an absorber that conveys the agents contained in the agent container to a substantially-closed, certain location using negative pressure; an agent conveyance conduit that forms an agent conveyance path between the agent container and the absorber; an air supplier that supplies air into the agent container; and an open/close unit that opens and closes the agent conveyance conduit.

The agent supplying device according to still another aspect of the present invention is provided with an agent container that contains powdery agents; an absorber that conveys the agents contained in the agent container to a substantially-closed, certain location using negative pressure; an agent conveyance conduit that forms an agent conveyance path between the agent container and the absorber; an air supplier that supplies air into the agent container; and a positive pressure generator that generates positive pressure in the agent conveyance conduit when the air supplier supplies the air.

The agent supplying device according to still another aspect of the present invention is provided with an agent container that contains powdery agents; an absorber that conveys the agents contained in the agent container to a certain location using negative pressure; a substantially-closed, agent conveyance path between the agent container and the absorber; an air supplier that supplies air into the agent container; and a controller that controls operations of the air supplier and the absorber, the controller actuating the air supplier when it is determined that an agent supplement amount by the absorber reaches a certain amount. The certain amount M is equal to or greater than 0.5 g.

The agent supplying device according to still another aspect of the present invention is provided with an agent container that contains powdery agents; an absorber that conveys the agents contained in the agent container to a certain location using negative pressure; a substantially-closed, agent conveyance path between the agent container and the absorber; an air supplier that supplies air into the agent container; and a controller that controls operations of the air supplier and the absorber, the controller actuating the air supplier when it is determined that an agent supplement amount by the absorber reaches a certain amount. If the certain amount is equal to a value based on the amount contained in the agent container.

The agent supplying device according to still another aspect of the present invention is provided with an agent container that contains powdery agents; an absorber that conveys the agents contained in the agent container to a certain location using negative pressure; a substantially-closed, agent conveyance path between the agent container and the absorber; an air supplier that supplies air into the agent container; and a controller that controls operations of the air supplier and the absorber, the controller actuating the air supplier when it is determined that an agent supplement amount by the absorber reaches a certain amount. If the certain amount is denoted with M, the controller varies the certain amount M based on the amount contained in the agent container.

These and other objects, features and advantages of the present invention are specifically set forth in or will become apparent from the following detailed descriptions of the invention when read in conjunction with the accompanying drawings.

BRIEF DESCRIPTION OF THE DRAWINGS

FIG. 12A and FIG. 12B are views of the embodiments of the nozzle of the toner supplement device, in which FIG. 12A is a front view thereof and FIG. 12B is a cross-sectional view thereof;

DETAILED DESCRIPTIONS

Exemplary embodiments of the present invention will be explained below in accordance with the accompanying drawings.

Figure 1:
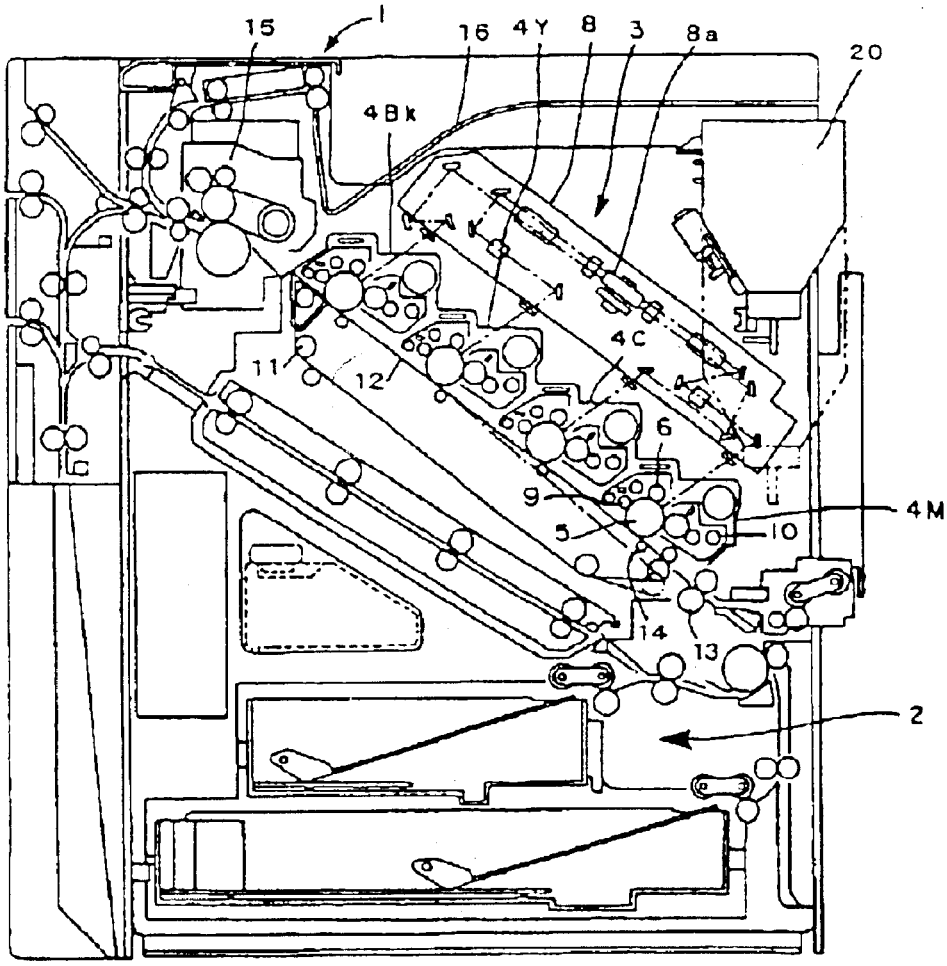
FIG. 1 is an arrangement diagram that shows the outline of an entire image formation device according to the present invention.

FIG. 1 shows an outline of a color laser printer, or an example of an image formation device, equipped with a toner supplement device as the agent supplying device according to a first embodiment of the present invention.

The color laser printer includes a device body 1, beneath which a paper feeder 2 is located, and above which an image formation section 3 is located. The image formation section 3 includes a transfer belt device located in such a manner that it tilts downward at the paper feed side (the right side in FIG. 1) and upward at the paper discharge side (the left side in FIG. 1). The transfer belt device includes a plurality of rollers 11, and an endless transfer belt 12 suspended around four rollers 11 in this embodiment. For the sake of clarity, the reference numeral is given only to one of the rollers 11 in FIG. 1. When a driving source, not shown, rotates one of the rollers 11, the transfer belt 12 is driven to rotate counterclockwise in the FIG. 1. On locations opposite to the upper surface of the transfer belt 12, four image formation units 4M, 4C, 4Y, 4Bk for magenta (M), cyan (C), yellow (Y), black (Bk) are arranged in parallel in turn from below.

The image formation units 4M, 4C, 4Y, 4Bk include a photosensitive drum 5 each as image carrier. For the sake of clarity, the reference numerals are given only to elements of the image formation unit 4M in the FIG. 1. When a driving unit, not shown, drives the photosensitive drum 5, it rotates clockwise in the FIG. 1. Those located around the photosensitive drum 5 include a charging roll 6 as a charging unit; an optical writing device 8 for laser writing in an optical writing section; a development device 10 as a development unit; and a cleaner 9 as a cleaning unit. The development device 10 comprises a development device of two-component consisting of toner and developer. Toner is supplied to the development device 10 from a later-described toner supplement device based on the toner amount consumed.

Operation of image formation will be explained next when the color printer shown in FIG. 1 forms a full-color print.

The image formation units 4M, 4C, 4Y, 4Bk operate as follows. Onto the photosensitive drum 5 charged from the charging roll 6, the optical writing device 8 optically writes optical images developed with toners of corresponding colors. The optical writing device 8 drives an LD (laser diode), not shown, to emit a laser beam to a polygon mirror 8*a* and leads the reflected light to the photosensitive drum 5 through a cylinder lens and so forth. The beam led to the photosensitive drum 5 is employed to write the optical images on the photosensitive drum 5. This write operation forms electrostatic latent images on the photosensitive drum 5 based on the image data sent from a host machine such as a personal computer. The development device 10 converts the latent images into visible images of toners.

The paper feeder 2 feeds a recording sheet of paper designated as a transfer material. The recording sheet thus fed is once pushed against a resist roller 13 located upstream in the conveyance direction from the transfer belt 12 and then conveyed onto the transfer belt 12 in synchronization with the visible images. The sheet arrives at a transfer location opposite to the photosensitive drum 5 as the transfer belt 12 runs. At the transfer location, the visible image of magenta toner is first transferred to the recording sheet by action of a transfer roll 14 located behind the transfer belt 12.

Similar to the above, also in the other image formation units 4C, 4Y, 4Bk, visible images of corresponding toners are each formed on respective surfaces of the photosensitive drum 5. These visible images are superimposed on the recording sheet when it is conveyed over the transfer belt 12 and arrives at each transfer location. The present color printer therefore has an advantage of the tandem type because a full-color image can be superimposed on the recording sheet in a short time period almost similar to that for a monochromic one. The recording sheet after transferring is separated from the transfer belt 12 and subjected to fixing at a fixing device 15. The recording sheet after fixing is typically discharged to outside the printer as it is. Alternatively, the recording sheet is turned upside down and discharged facedown to a discharge tray 16 provided on the upper side of the device body 1. The facedown discharging of the sheets is almost essentially required, by a printer, to arrange prints in a page order.

The development device 10 is of a two-component type that monitors a mixture ratio of toner to carrier in the device and supplies toner by an amount corresponding to the reduced toner. Such the toner supplement is achieved as follows. The toner is contained in a toner container 20 located at a location apart from the development device, above the right side in FIG. 1 in the first embodiment, and is supplied through a toner supplement device. In the first embodiment, the toner container 20 configures an agent container that contains toner or powdery agents, and the toner supplement device configures an agent supplying device.

The toner supplement device is explained in detail next with reference to FIG. 2.

A toner supplement device 500 includes an absorbing powder pump 40 located near or integrally with the development device 10. In the first embodiment, the powder pump 40 comprises a single-axial eccentric screw pump, which includes a rotor 41, a stator 42, and a holder 43. The rotor 41 is composed of a stiff material such as a metal and is shaped in the form of an eccentric screw. The stator 42 is composed of an elastic material such as a rubber, having a through hole in the form of a double-helix screw. The holder 43 is employed to hold the stator 42 not to rotate and is composed of the same material as the resinous material that forms the conveyance path for the power. The rotor 41 is joined to a driving rod 44 through a pin joint that can absorb the eccentric motion. A gear (not shown) is secured on the driving rod 44. With this arrangement, driving to the gear, not shown, can be connected and disconnected by controlling on/off of a clutch (not shown). Such the on/off control can be performed by a controller 300 that includes a microprocessing unit and the like. Thus, the powder pump 40 can be drive-controlled by the controller 300.

Figure 2:
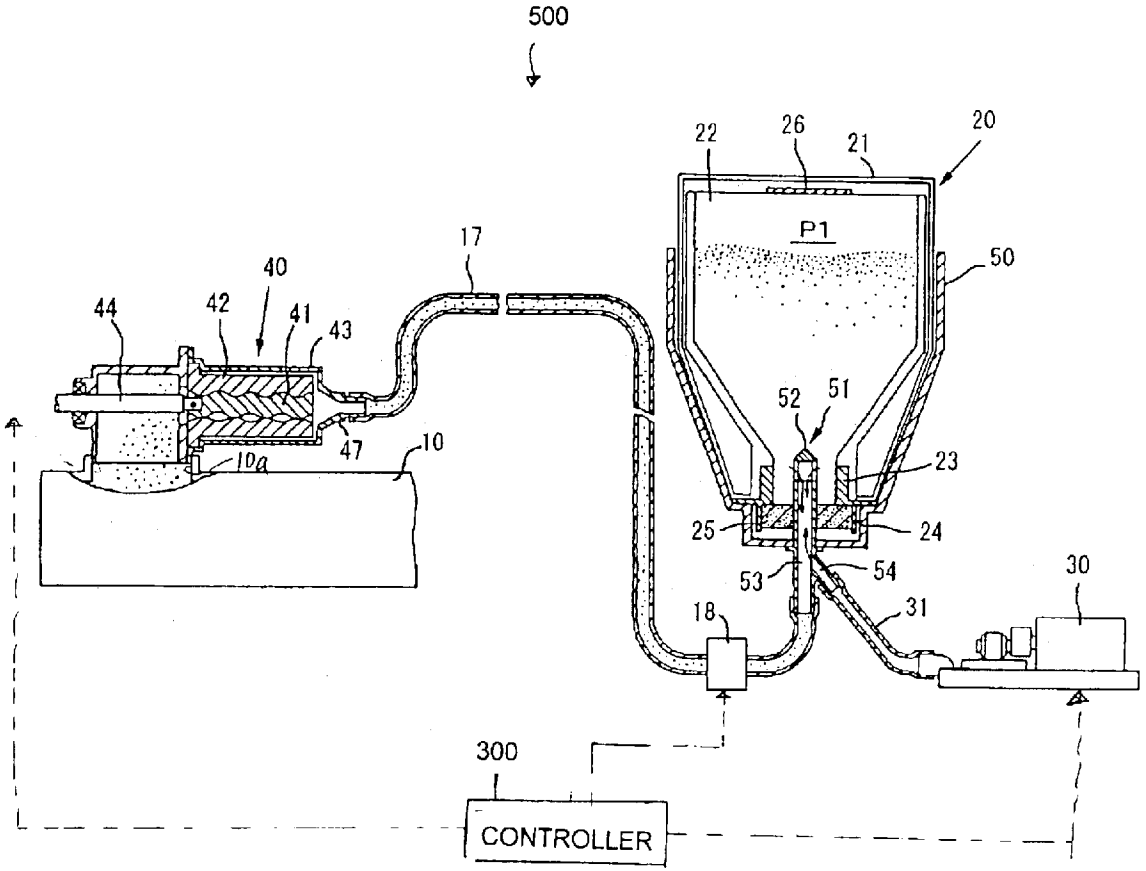
FIG. 2 is an illustrative cross-sectional view of a toner supplement device according to the first embodiment of the present invention.

At the tip of the holder 43, or the right side in FIG. 2, a toner absorber 47 is located. The toner absorber 47 is connected through a toner conveyance tube 17 to the lower end of a toner passage 53 in a nozzle 51 later described. The toner conveyance tube 17 configures an agent conveyance conduit as a toner conveyance path between the toner container 20 and the powder pump 40. It is extremely effective to use such a flexible tube as the toner conveyance tube 17 that has a diameter of 4 to 10 mm and is composed of a rubber material excellent in toner resistance (such as polyurethane, nitrile, EPDM (ethylene-propylene-diene-terpolmer) and silicone). If the tube is flexible it can be easily piped in any directions vertically and laterally. Though it is not limited to this example.

On the other hand, the toner container 20 containing toner to be supplemented to the development device 10 is set in a container holder 50 in a set section. The nozzle 51 with a circular cross section inserted into the toner container 20 stands in the container holder 50. When the toner container 20 is set from above into the container holder 50 that is a set section in the image formation device body 1, the upper end of the nozzle 51 is inserted into the toner container 20. The nozzle 51 has a sharp tip 52 formed conical in cross section at the upper end. It has an inner structure of a single pipe, that includes a passage 53 formed therein to serve as an air passage and a toner passage. The toner conveyance tube 17 is attached to the lower end of the nozzle 51. The passage 53 has an air inlet 54 formed above the location, to which the toner conveyance tube 17 is attached.

The air inlet 54 is connected through an air transfer pipe 31 to an air pump 30. The air pump 30 is employed to generate a flow rate of 1 to 3 L per minute. When the air pump 30 operates, air from the pump is blown out inside the toner container 20 from beneath through the air transfer pipe 31 and the passage 53. When the air blown into the toner container 20 passes through layers of the toner contained therein, it agitates the toner with a poor fluidity to fluidize it as a liquid. An on/off valve (not shown) may be provided in the air transfer pipe 31 to prevent the toner from entering into the air pump. The controller 300 controls driving of the air pump 30. The air pump 30 in the first embodiment configures an air supplier that supplies air into the toner container 20 that is an agent container.

The toner container 20 in the first embodiment is configured in a bag-in-box type that includes an outer box 21 as a protective case, and a toner bag 22 as a flexible and deformable container body detachably contained in the outer box 21. The outer box 21 is composed of a material with a certain stiffness that can sustain its shape, such as paper, corrugated paper and resin to form an inner space to contain the toner bag 22 therein.

The toner bag 22 has a bag portion composed of a flexible sheet material (80–200 $\mu$m thick) such as a polyester film and a polyethylene film. The bag portion of the toner bag 22 is produced like formation of a folded paper using the sheet material in a single-layered or multi-layered arrangement. It is shaped in a tightly-closed bag-type container to prevent air from flowing in and out. The toner bag 22 is pressed to form a sharp tip tapering from a vertically appropriate middle portion to the outlet at the bottom. This is effective to discharge the toner contained in the bag to outside therefrom.

At the center in the sharp lower portion of the toner bag 22, a cap 23 composed of a resin such as polyethylene and nylon is provided. The cap 23 includes a case 24 composed of a resin such as polyethylene and nylon, and a seal 25 composed of an elastic material such as sponge and rubber. Desirably, the case 24 and the seal 25 are composed of the same material in view of recycle and easiness of welding to the bag container.

The seal 25 has a slit cut in cross. When the nozzle 51 is inserted into the slit, the seal can tightly contact the nozzle 51 and prevent toner from leaking out of the toner container 20 to outside the device. When the toner container 20 is removed, the slit of the seal 25 elastically closes and prevents toner from leaking. The slit has a length equal to the outer diameter of the nozzle 51 or about 3 mm larger. The seal 25 is adhered to the case 24 using a double-sided adhesive tape, for example. Preferably, the seal 25 is composed of a material with toner resistance, extremely less air permeance, and excellent anti-creep strength.

In the toner container 20 thus configured, the toner is contained in the flexible toner bag 22. Even though, the toner bag 22 can be protected from external shocks when it is contained in the outer box 21. In addition, due to the improved handling possibility, the container can be easily handled and easily arranged during storage.

In the toner supplement device 500 with the above arrangement, when the rotor 41 rotates in the powder pump 40, the pump generates a strong self-absorbing force (absorbing pressure), that can absorb toner from the toner container 20. Therefore, in the first embodiment, the powder pump 40 configures an absorber. The absorber is not limited to the powder pump 40 as configured above. For example, it may be any other device that can absorb toner contained in the toner container 20 therefrom using negative pressure.

The toner in the toner container 20 drops near the nozzle 51 by gravity at any time. The toner is conveyed to the outside of the container utilizing the absorbing force from the powder pump 40. Because of the poor fluidity of the electrographic toner, after the powder pump 40 absorbs the toner near the nozzle 51, bridges may possibly be formed in the container.

The air pump 30 supplies air into the toner container 20 to agitate and fluidize the toner to prevent the toner from forming the bridges. Accordingly, the bridges possibly formed in the toner container 20 can be broken when the air is supplied. This is effective to stabilize the amount of toner supplement and reduce the amount of toner resided in the container.

In the toner supplement device 500, the development device 10 includes a permeability detector (not shown) as a toner density detector. When the permeability detector detects a toner density below a predetermined density, it generates a toner supplement signal. When the toner supplement signal is generated, under control of the controller 300, the clutch, not shown, is turned on. As a result, a rotational driving force is transmitted from a driving source (not shown) of the image formation device through the driving rod 44 to the rotor 41 to operate the powder pump 40. When the powder pump 40 operates, the consequent absorbing negative pressure allows the toner contained in the toner container 20 to be supplied by a certain amount to the development device 10. The toner density detector is not limited to the permeability detector. For example, it may be one that detects a density reflected from the toner image on the photosensitive material. The powder pump 40 may be driven from an individual motor without locating the clutch.

Figure 3:
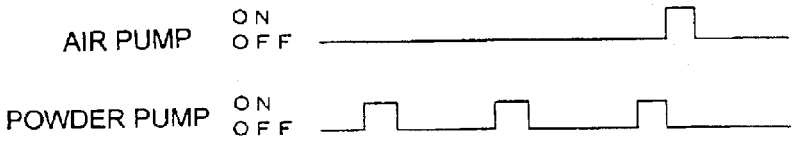
FIG. 3 is a timing chart that shows an example of operation timings of a powder pump and an air pump.
Figure 4:
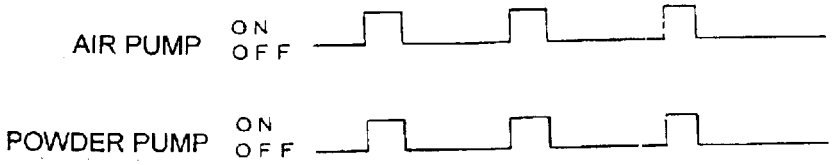
FIG. 4 is a timing chart that shows questionable operation timings of the powder pump and the air pump.

The controller 300 controls the air supply in the manner as shown in FIG. 3. When an accumulated operation time of the powder pump 40 reaches a certain value (for example, 1 sec accumulated), it is determined that a certain amount of toner is supplied. The controller then halts the powder pump 40 and immediately afterwards (after the powder pump 40 terminates the third operation in the shown example) operates the air pump 30. The controller 300 controls the air pump 30 not to be driven simultaneously with the powder pump 40. If the air pump 30 and the powder pump 40 are driven simultaneously as shown in FIG. 4, the air is sent to the powder pump 40 and the toner in the container 20 may not be agitated sufficiently.

The toner absorbed by the powder pump 40 drops into the development device through a toner introduction hole 10*a* provided at a part of the development device 10, and is conveyed to a development section by an agitating conveyance member, not shown, in the development device. If the two-component development is applied, the toner supplied during the conveyance is agitated and mixed with a developer in the development device to have a uniform agent density and an appropriate charge.

In the toner supplement device 500, when the toner is conveyed (the powder pump 40 operates), the toner conveyance tube 17 is filled with the toner. This situation can be maintained substantially when the powder pump 40 halts. When the air is supplied, the toner in the toner container 20 is fluidized as described above. When the air is supplied further, the pressure P1 in the container 20 elevates. A path from the toner container 20 through the toner conveyance tube 17 to the powder pump 40 is tightly closed to generate negative pressure when the powder pump 40 operates. Therefore, the fluidized toner flushes out of the toner container 20 into the toner conveyance tube 17. As a result, the toner filled in the toner conveyance tube 17 may be easily pushed therein and compressed easily. If the nozzle 51 employed is of the single tube type that is shared by the air supply path and the toner supply path as shown in FIG. 2, when air is supplied, the air is directly sent into the toner conveyance tube 17. This air may possibly push the toner in the toner conveyance tube 17. If these operations are frequently repeated, the toner in the toner conveyance tube 17 is compacted. As a result, the toner is "clogged" as explained earlier and can not be conveyed even when the powder pump 40 operates.

Figure 5:
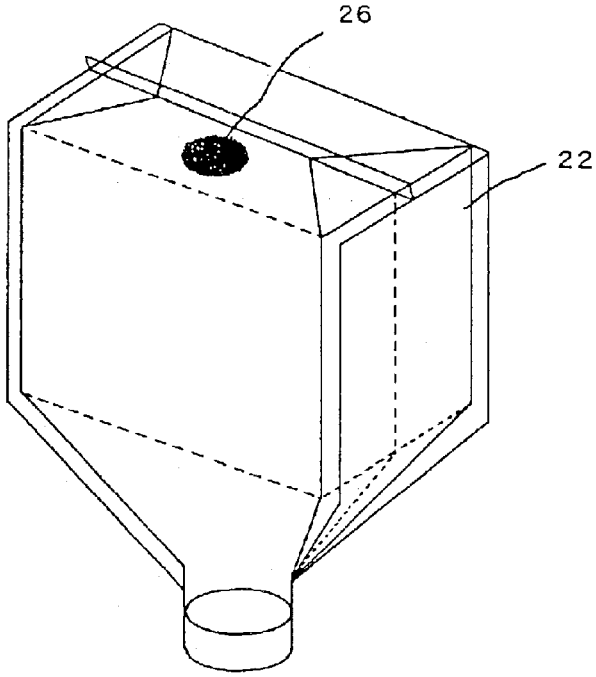
FIG. 5 is a perspective view that shows a toner bag of a toner container.

As shown in FIG. 5, a ventilating filter 26 may be provided on the upper portion of the toner bag 22. This is known to reduce the pressure in the container and prevent it from elevating to positive pressure due to the air supplied from the air pump 30. The air is supplied from the lowermost portion of the toner container 20, so a long time period is required until the air passes through the toner layer to the ventilating filter 26. Accordingly, before the supplied air passes through the ventilating filter 26, its pressure pushes the toner in the toner conveyance tube 17.

In the first embodiment, as shown in FIG. 2, an on/off valve 18 is located between the nozzle 51 and the powder pump 40 as an open/close unit that opens and closes the toner conveyance path. The on/off valve 18 may be located at a portion of the nozzle 51, to which the toner conveyance tube 17 is attached. Alternatively, it may be located at a toner absorbing section 47 of the powder pump 40. Any appropriate location on the toner conveyance tube 17 is available to locate the valve conveniently because the tube is formed flexible.

As explained, the on/off valve 18 is provided in the toner supplement path extending to the powder pump 40, and the controller 300 controls the valve 18 to close in synchronization with the air supply timing. Accordingly, it is possible to prevent the supplied air from flowing into the toner conveyance tube 17. It is also possible to prevent the toner from clogging due to the air. If the toner bag 22 of the toner container 20 is composed of a flexible material as is in the first embodiment, it is possible to relieve the pressure elevation inside the toner bag 22 when the flexible material deforms. Accordingly, a much larger amount of air can be sent to the container. This is effective to reduce the amount of toner resided in the container when the toner finishes.

The on/off valve 18 is required to turn off a powder rather than gas and liquid. Powder is hard to handle because its particle is fine. In addition, it may cause a risk because it possibly invites defects once entered inside the valve. The following arrangement may be applied instead of the on/off valve 18 to prevent occurrence of malfunctions.

Figure 6:
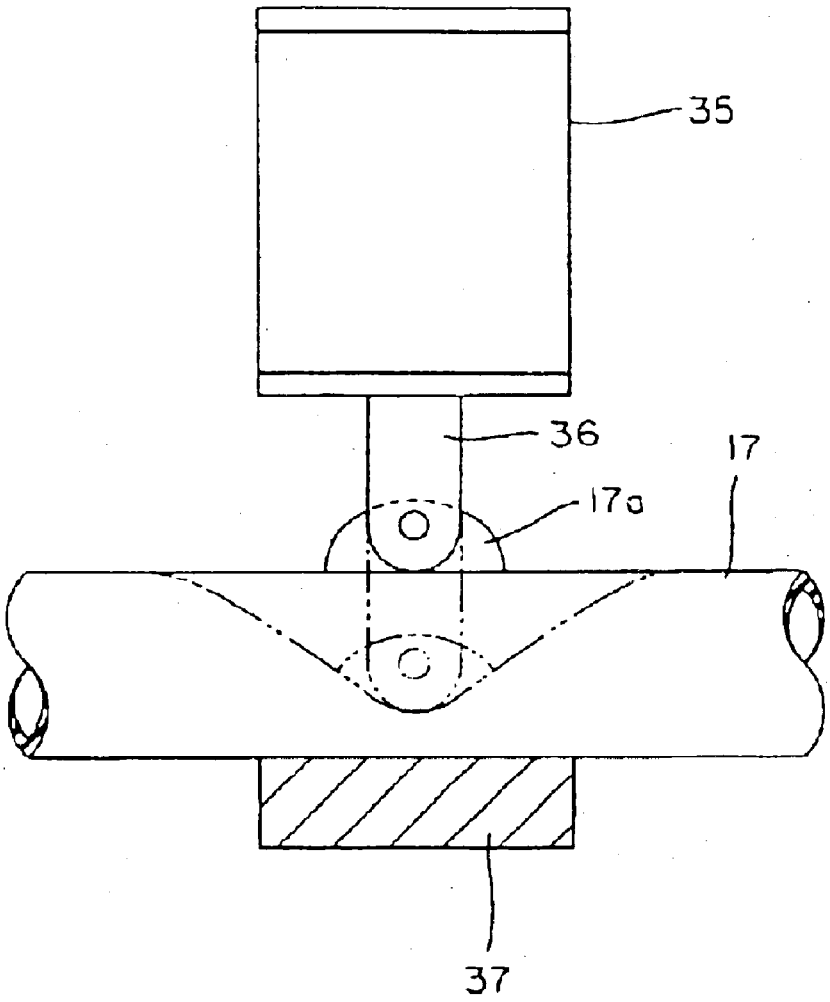
FIG. 6 is an illustrative diagram that shows an example of an open/close unit.

An open/close unit shown in FIG. 6 may be employed to open and close the toner conveyance tube 17 without using the on/off valve 18.

As shown in FIG. 6, the open/close unit is provided at an appropriate location on the toner conveyance tube 17. It includes a solenoid 35 as a presser that presses the tube from the outside. The solenoid 35 has a plunger 36. A backup plate 37 is located on the opposite side of the toner conveyance tube 17 than is the plunger 36. As described above, the toner conveyance tube 17 comprises a flexible tube. Though, when the solenoid 35 is turned on to operate the plunger 36 as shown with a chain line, the use of the backup plate 37 makes it possible to sandwich the tube between the plunger 36 and the backup plate 37 to close the toner path.

When the solenoid 35 is turned off, the plunger 36 returns to its original position shown with a solid line. Consequently, the tube 17 elastically restores its original feature. A tab 17*a* may be provided integrally with the toner conveyance tube 17 and linked to the plunger 36 of the solenoid 35 to fast restore the toner conveyance tube 17.

According to such arrangement, the toner conveyance tube 17 can be opened and closed without the use of the on/off valve 18, and the open/close unit suffers no ill effect such as errors due to the powder. Therefore, when the solenoid 35 is turned on to close the toner conveyance tube 17 in synchronization with the air supply timing, the toner can be prevented from clogging due to the air. The solenoid 35 is of a self-holding type held at two positions. A typical solenoid may also be employed if a spring is provided appropriately, for example. The presser that presses the toner conveyance tube 17 from the externals is not limited to the solenoid. For example, it may employ a cam.

Figure 7:
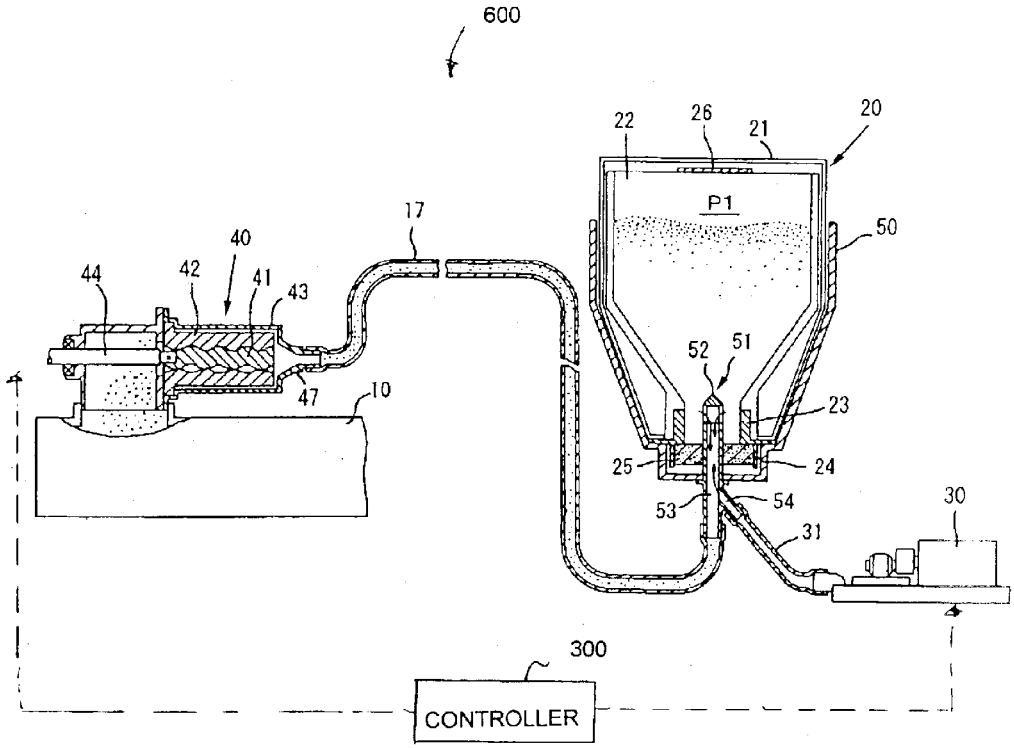
FIG. 7 is an illustrative cross-sectional view of a toner supplement device according to the second embodiment of the present invention.

FIG. 7 is an arrangement diagram of the toner supplement device according to a second embodiment of the present invention. A toner supplement device 600 can be incorporated into an image formation device similar to the first embodiment (see FIG. 1). The toner supplement device 600 according to the second embodiment has a fundamental mechanism for toner conveyance similar to the first embodiment shown in FIG. 2, in that the same elements are denoted with the same reference numerals. It is different from the device according to the first embodiment in that: the valve 18 is not provided in the toner conveyance tube 17; and the powder pump 40 is driven by a special-purpose normally and inversely rotatable driver such as a motor (not shown).

In the second embodiment, when the controller 300 drives the air pump 30 to supply air, it controls the powder pump 40 as follows. The controller 300 drive-controls the powder pump 40 to generate discharging pressure by rotating the powder pump 40 in the direction opposite to the rotational direction employed to absorb the toner from the toner container 20 and convey it to the development device 10. The single-axial eccentric screw pump serving as the powder pump 40 can generate absorbing pressure (negative pressure) and discharging pressure (positive pressure) corresponding to the rotational direction of the rotor 41. When the air is supplied into the toner container 20 as above, the discharging pressure (positive pressure) is generated. This is employed to inhibit the air generated at the air pump 30 from flowing into the tube to prevent occurrence of the clogged toner. If the positive pressure generated at the powder pump 40 is set to the pressure resistance (generating pressure) or more of the air pump 30, the air can be supplied to the toner container 20 without flowing into the toner conveyance tube 17. Therefore, it is preferable to set in this way. The powder pump 40 in the second embodiment configures a positive pressure generator. When the rotational direction of the rotor 41 is altered in the second embodiment, the powder pump 40 can serve as either the absorber or the positive pressure generator. The positive pressure may also be generated from a pump provided separately from the powder pump 40 or the absorber.

According to the above arrangement, a stable toner supplement device can be provided because the toner is prevented from clogging in the toner conveyance tube 17.

Figure 8:
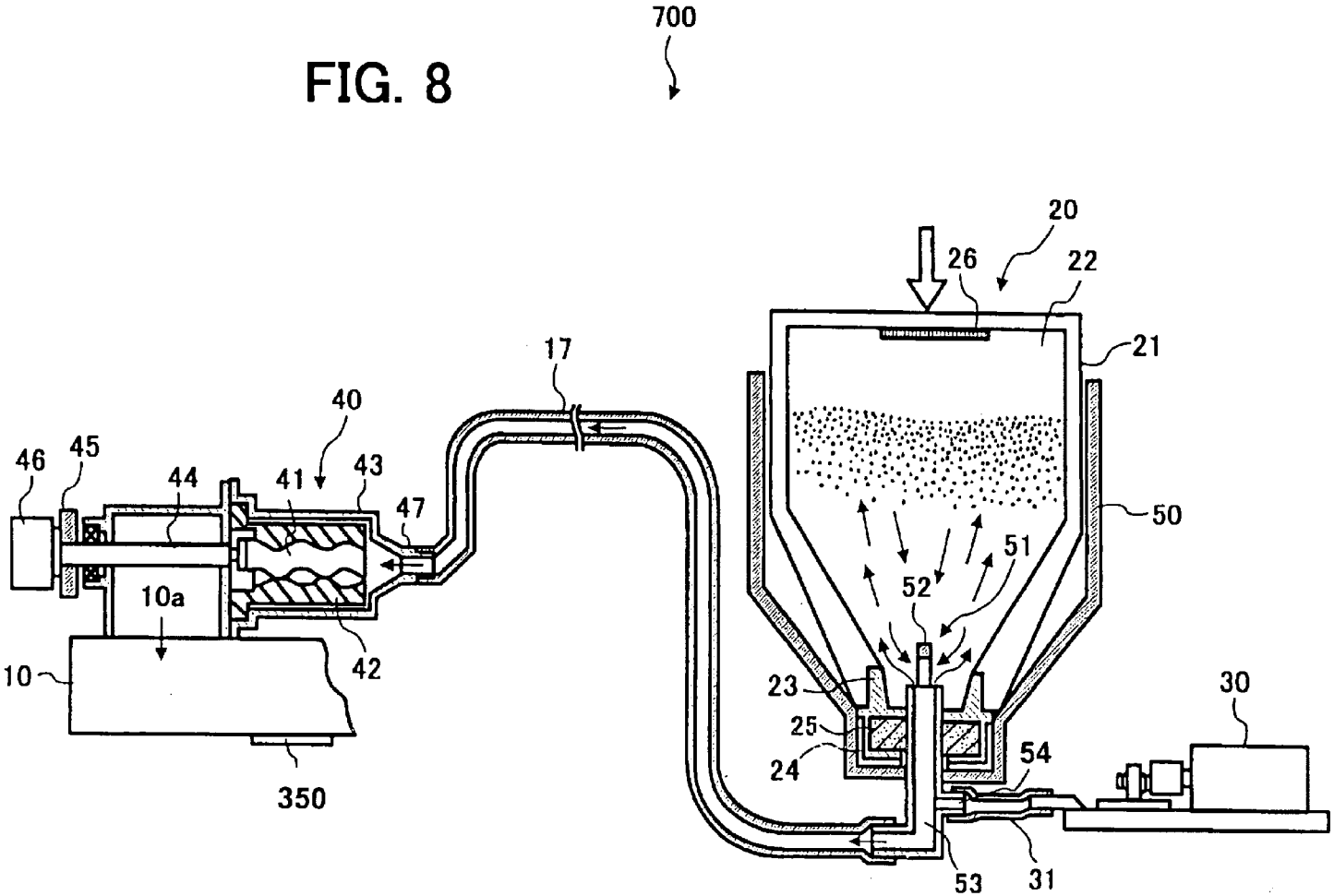
FIG. 8 is an illustrative cross-sectional view of a toner supplement device according to the third embodiment of the present invention.

An image formation device provided with the toner supplement device according to a third embodiment of the present invention will be explained next. As shown in FIG. 8, a toner supplement device 700 according to the third embodiment has a mechanism for toner conveyance similar to the first embodiment shown in FIG. 2. The entire arrangement of the image formation device with such the toner supplement device is also similar to that of the first embodiment (see FIG. 1). It is different from the first embodiment in that: the valve 18 is not provided in the toner conveyance tube 17; and the air pump 30 and the powder pump 40 are driven under different controls from the first embodiment, which are explained mainly. In the third embodiment, like reference numerals are given to the elements common to those in the first embodiment and omitted to explain them.

In the toner supplement device 700 of the third embodiment, the development device 10 includes a permeability detector 350 as a toner density detector. The permeability detector 350 detects a toner density in the development device 10 and generates a toner supplement signal if the detected toner density is below a predetermined density. When the toner supplement signal is generated, a microprocessing unit, later described, executes a control to turn on a clutch 46. As a result, the rotational driving force is transmitted from the driving source (not shown) of the image formation device to a driving rod 45 to operate the powder pump 40. When the powder pump 40 operates, the consequent absorbing negative pressure allows the toner contained in the toner container 20 to be supplied by a certain amount to the development device 10. The toner density detector is not limited to the permeability detector. For example, it may be one that detects a density reflected from the toner image on the photosensitive material. The powder pump 40 may be driven by an individual motor without providing the clutch.

Figures 9, 10:
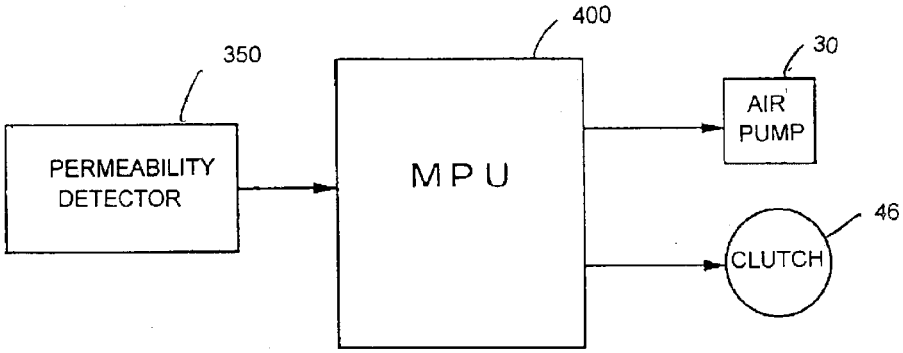
FIG. 9 is a control block diagram of the toner supplement device according to the present invention.
FIG. 10 is a table that shows experimented results on relations between the toner supplement amount and the air supply.

FIG. 9 is a block diagram of the control system for toner supplement in the toner supplement device.

The toner supplement device 700 of the third embodiment includes a micro-processing unit (hereinafter referred to as MPU) 400 as a controller that controls its drive using a developer density sensing method publicly known in the art. In the third embodiment, as described above, the development device 10 includes the permeability detector 350 that detects a variation in the mixture ratio of toner to developer. The MPU 400 takes the detected result from the permeability detector 350 that detects an image density. The MPU 400 generates a toner supplement signal that includes an operation time of the powder pump 40 determined based on the detected result from the permeability detector 350 and the image data (the number of pixels) to drive-control the powder pump 40.

The MPU 400 controls the air supply in the manner as shown in FIG. 3. When an accumulated operation time of the powder pump 40 reaches a certain value (for example, 1 sec accumulated), it is determined that a later described certain amount M of toner is supplied. The MPU then halts the powder pump 40 and immediately afterwards operates the air pump 30. The MPU 400 controls the air pump 30 not to be driven simultaneously with the powder pump 40. If the air pump 30 and the powder pump 40 are driven simultaneously as shown in FIG. 4, the air is sent to the powder pump 40 and the toner in the container 20 may not be agitated sufficiently.

As shown in FIG. 8, the toner absorbed by the powder pump 40 drops into the development device 10 through the toner introduction hole 10*a* provided at a part of the development device 10. It is conveyed to a development section by an agitating conveyance member, not shown, in the development device 10. If the two-component development is applied, the toner supplied during the conveyance is agitated and mixed with a developer in the development device to have a uniform agent density and an appropriate charge.

In the third embodiment, similar to the first embodiment, when the toner is conveyed (the powder pump 40 operates), the toner conveyance tube 17 is filled with the toner. This situation can be maintained substantially when the powder pump 40 halts. When the air is supplied, the toner in the toner container 20 is fluidized as described above. When the air is supplied further, the pressure P1 in the container 20 elevates. A path from the toner container 20 through the toner conveyance tube 17 to the powder pump 40 is tightly closed to generate negative pressure when the powder pump operates. Therefore, the fluidized toner flushes out of the container into the tube. As a result, the toner filled in the tube 17 may be pushed therein and compressed easily. If the nozzle 51 employed is of the single tube type shared by the air supply path and the toner supply path as shown in FIG. 8, when air is supplied into the container, the air is also directly sent into the toner conveyance tube 17. This air may possibly push the toner in the toner conveyance tube 17. If these operations are frequently repeated, the toner in the toner conveyance tube 17 is compacted. As a result, the toner is "clogged" as explained earlier and can not be conveyed even when the powder pump 40 operates.

Similar to the first embodiment, as shown in FIG. 5, the ventilating filter 26 may be provided on the upper portion of the toner bag 22. This is known to reduce the pressure in the container and prevent it from elevating to positive pressure due to the air supplied from the air pump 30. The air is supplied from the lowermost portion of the toner container 20, so a long time period is required until the air passes through the toner layer to the ventilating filter 26. Accordingly, before the supplied air passes through the ventilating filter 26, its pressure pushes the toner in the toner conveyance tube 17.

The Inventors have repeated various experiments and studies on the "clogging" phenomenon, and elucidated the generation mechanism and found a certain condition on its generation. FIG. 10 is a table that shows the results of these experiments.

In these experiments, the drive control is performed at the timing shown in FIG. 3 and air is supplied when the toner supplement amount reaches a certain amount. When the certain amount is denoted with Mg, M is selected at several points between 0.1 g and 2 g. Other conditions include a flow rate of 2 L/min and an air supply time of 1 sec per one motion of the air pump 30, and two types of electrographic dry toners A and B with different formulations are employed. The toner A is toner that has actually clogged easiest. The toner B is toner that has hardly clogged. A toner supplement amount is measured when 1 kg of the toner in total is supplied, and clogging in the tube is touched and confirmed manually after supplement. The mark "x" indicates that the toner supplement is stopped on the way and the clogged toner is confirmed in the tube. The mark "Δ" indicates that the toner supplement is performed to the end but slightly or apparently clogged portions are confirmed in the tube after supplement. The mark "O" indicates that the toner supplement is performed to the end and no clogged toner is confirmed in the tube after supplement. This result shows that the toner supplement can be performed to the end if the air is supplied every time the toner is supplied by $M \geqq 0.5$ g for the toner A, and $M \geqq 0.2$ g for the toner B. Therefore, it is found that even the actually easiest clogged toner is hardly clogged if the certain amount M is 0.5 g or more consequently.

Figure 11:
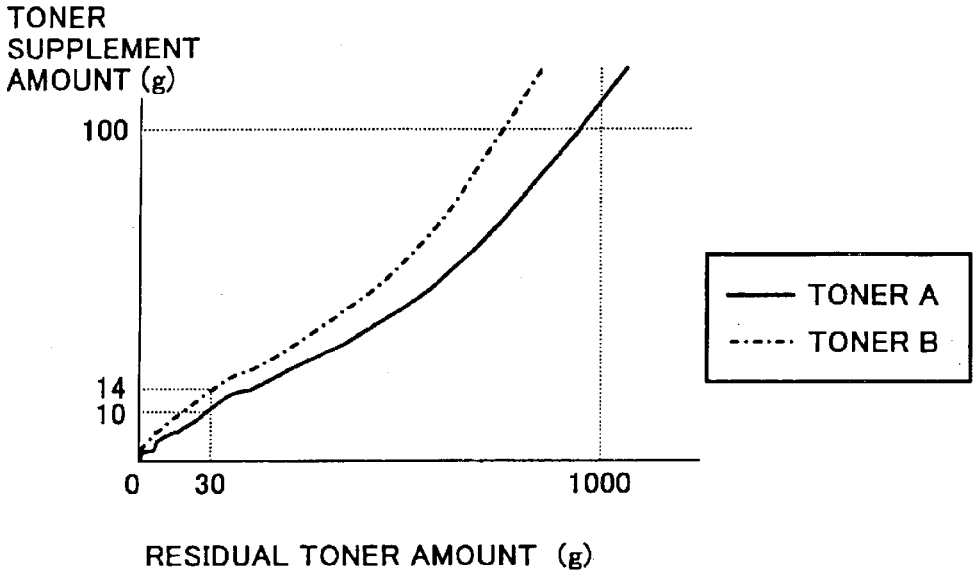
FIG. 11 is a graph that shows relations between the toner amount supplied possibly without air supply and the toner amount contained.

FIG. 11 is a graph that shows the amount of toner resided in the toner container 20 and the amount of toner possibly supplied without air supply. The toners A and B are the same types as those for use in the experiments shown in FIG. 10.

As obvious from the graph shown in FIG. 11, the experimented results indicate that the amount of toner possibly supplied without air supply reduces as the amount of toner resided in the toner container 20 lowers. It can be considered that the less the amount of toner resided in the toner container 20 is, the more bridges are formed easily. This means that a less amount of resided toner requires a more frequency of air supplies.

In many color copiers and color printer products, the amount of resided toner in the container when the toner end has a specified value of 30 g or less. In consideration of this point, to achieve a residual toner amount of 30 g or less, the certain amount M is determined 10 g or less for the toner A and 14 g or less for the toner B. Accordingly, if a residual toner amount of 30 g is taken as a guide, it is required to satisfy $M \leqq 10$ g. Thus, considering that the clogging is hardly caused if the certain amount M is 0.5 g or more, it is effective to set the certain amount M within a range, 0.5 g≦M≦10 g, because the clogging is hardly caused in this range and the residual toner amount can be suppressed to 30 g or less. Therefore, the MPU 400 in the third embodiment sets the certain amount M within such the range and, when the certain amount M of toner is supplied, it drive-controls the air pump 30 to supply air to the toner container 20.

The toner container 20 for use in a typical color copier and a color printer product is replaced manually by the user. Therefore, the toner container 20 contains a content of 1000 g at most. If it is 1000 g or more, its manual operation becomes hard. If the maximum toner content in the toner container 20 is determined 1000 g, the largest amount possibly supplied without air supply is substantially 100 g as obvious from FIG. 11. In consideration of this point, the certain amount M can be set to 100 g at most, that is, M≦100 g.

For example, it is assumed that an initial toner is 1000 g and air is supplied every time when 100 g is supplemented. In this case, after a first 100 g supplement, the residual toner amount comes down to 900 g. As a result, the amount possibly supplemented without air supply comes down to an amount less than 100 g. If the certain amount M is altered based on the toner residual amount in the toner container 20, the air can be supplied at an appropriate time interval based on the toner residual amount. For example, if the initial toner content is 1000 g as is in the above example, air is supplied when 100 g is supplemented. After the initial toner content comes down to 900 g, the certain amount M is altered to 90 g. In this way, if the certain amount M is altered based on the toner residual amount, and the air supply is altered corresponding to the toner residual amount, the certain amount M can be set M≦100 g. Therefore, the. MPU 400 in the third embodiment alters the certain amount M based on the toner residual amount and supplies air when the toner residual amount reaches the certain amount M. If the certain amount M is reduced based on the toner residual amount, the certain amount M comes to M≦10 g finally.

If the certain amount M is altered based on the amount of toner contained in the toner container 20, the certain amount M is M≦100 g initially at beginning of use. The initial certain amount M is set based on the initial toner amount in the toner container 20 and is then reduced based on the content. This is effective to avoid excessive air supply and prevent toner from clogging.

In the third embodiment, it is possible, under the air supply control, to suppress the clogging due to air. Though, if the MPU 400 is required to execute these controls accurately, it is important to know the toner supplement amount precisely. If the toner supplement amount can not be known precisely to some extent, there remains a high risk to cause a state of air rich or air poor. In the third embodiment, a single-axial eccentric screw pump is employed as the powder pump 40. It is known that the pump can convey a certain amount continuously at a high solid-to-gas ratio and obtain a precise toner conveyance amount in proportion to the revolutions of the rotor 41. Therefore, the MPU 400 can count the operation time of the powder pump 40 to assume the supplement amount, and supply air when it detects that the supplement amount reaches the certain amount M. The toner residual amount in the toner container 20 can be easily calculated based on the toner supplement amount. Accordingly, the toner supplement amount can be known accurately to some extent.

The clogged toner due to air is caused easily if the single pipe nozzle 51 is employed as shown in FIG. 8 because the supplied air is not entirely directed to the toner container 20 but partly branched to the toner conveyance tube 17. The nozzle 51 may have separated toner and air paths.

Figure 12A:
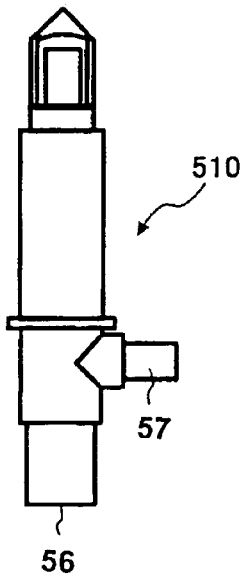
Figure 12B:
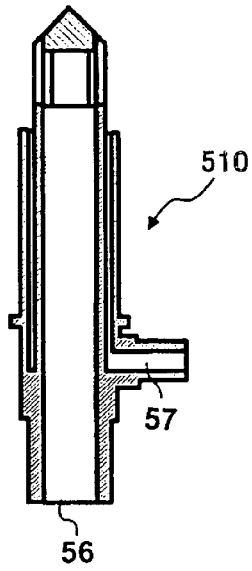
Figure 13:
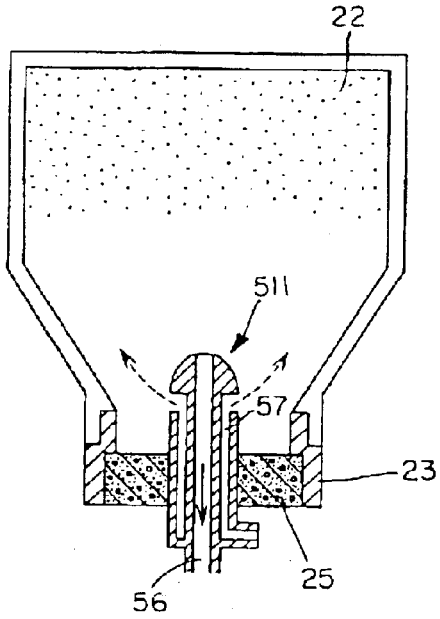
FIG. 13 is a cross-sectional view that shows another embodiment of the nozzle.
Figure 14:
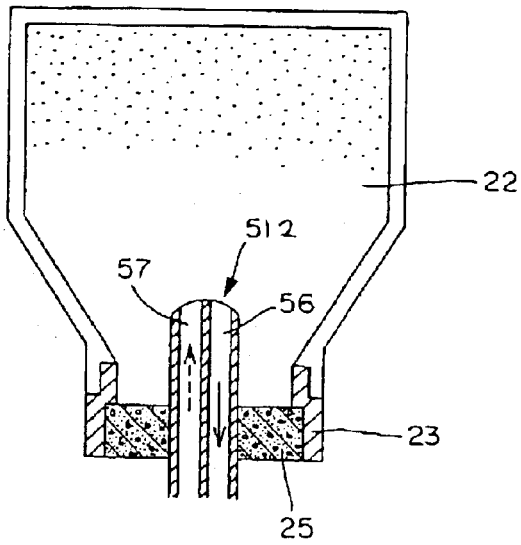
FIG. 14 is a cross-sectional view that shows yet another embodiment of the nozzle.

For example, as shown in FIG. 12A, FIG. 12B, and FIG. 13, a nozzle 510 or a nozzle 511 with separate toner and air paths may be employed. The nozzles 510 and 511 have different tip shapes but a common double-pipe structure that includes an air path 57 located around a toner path 56. The use of the double-pipe structure nozzle with separated toner and air paths 56 and 57 can effectively prevent the air from flowing into the toner conveyance tube 17. Alternatively, the toner path and the air path may be interchanged and the toner path 56 may be located around the air path 57. It is not limited to the double-pipe structure so long as the air path is separated from the toner path. For example, a nozzle 512 shown in FIG. 14 may be applied, in which a partition in the axial direction is employed to divide a passage to form the toner path 56 and the air path 57.

The present invention is not limited to the embodiments explained above but can be modified variously.

For example, in the embodiments, the toner supplement device (500, 600, 700) that supplies toner to the development device 10 is explained as the agent supplying device. The present invention is applicable to supplying toner to a hopper of the development device. It is also applicable to supplying a developer consisting of toner and carrier, as well as carrier alone.

In the third embodiment, the certain amount M is determined 0.5 g or more, not to clog even the toner A that has actually clogged easiest (see the experimented result in FIG. 10). If the toner (agents) to be employed may be predetermined, the certain amount M may be set to a value based on the toner. In this case, an appropriate certain amount M per type of toner to be employed is obtained previously by experiment, for example. Thus, the MPU 400 can set a certain amount M based on the type of toner to be employed.

According to the present invention, an open/close unit is provided to open and close the agent conveyance conduit. Therefore, it is possible to prevent the agents from clogging due to air by closing the conveyance conduit when the air is supplied.

Moreover, the open/close unit comprises of an on/off valve located in the agent conveyance conduit. Therefore, it is possible to open and close the agent conveyance conduit with the operation of the valve.

Furthermore, the agent conveyance conduit comprises of a flexible tube, and the open/close unit comprises a presser movable between a location for press-closing the tube from the externals and a location for releasing the closed tube. Therefore, it is possible to open and close the conveyance conduit by pressing it from the externals.

Moreover, a positive pressure generator generates positive pressure in the agent conveyance conduit when the air supplier supplies the air. Therefore, it is possible to prevent the agents from clogging due to air without opening/closing the agent conveyance conduit.

Furthermore, the absorber comprises of a single-axial eccentric screw pump that includes a normally/inversely rotatable rotor to generate negative pressure when the rotor rotates normally, and the positive pressure generator comprises the single-axial eccentric screw pump with the rotor driven to rotate inversely. Therefore, it is possible to generate positive pressure in the agent conveyance conduit using the absorber.

Moreover, the positive pressure generator generates positive pressure of pressure resistance or more of the air supplier. Therefore, it is possible to prevent the clogging due to air using the positive pressure.

Furthermore, an open/close unit is provided to open and close the agent conveyance conduit. Therefore, it is possible to prevent the agents from clogging due to air by closing the conveyance conduit when the air is supplied.

Moreover, a positive pressure generator generates positive pressure in the agent conveyance conduit when the air supplier supplies the air. Therefore, it is possible to prevent the agents from clogging due to air without opening/closing the agent conveyance conduit.

Furthermore, the controller actuates the air supplier when it is determined that an agent supplement amount by the absorber reaches a certain amount. In this case, the certain amount is denoted with M, and it satisfies $M \geqq 0.5$ g. Therefore, it is possible to prevent the agents from clogging due to air rich.

Moreover, the controller actuates the air supplier when it is determined that an agent supplement amount by the absorber reaches a certain amount. In this case, the certain amount is equal to a value based on the agents contained in the agent container, that is, the agent to be supplied. Therefore, it is possible to prevent the agents from clogging due to air rich.

Furthermore, the absorber comprises of a single-axial eccentric screw pump that absorbingly conveys the agents using negative pressure. Therefore, it is possible to perform a stable agent supplement.

Moreover, the certain amount M satisfies $10\ g \geqq M \geqq 0.5$ g. Therefore, it is possible to prevent the agents from clogging due to air rich and reduce the residual amount when agents end.

Furthermore, the controller actuates the air supplier when it is determined that an agent supplement amount by the absorber reaches a certain amount. In this case, the certain amount is denoted with M, and the certain amount M is varied based on the amount contained in the agent container. Therefore, it is possible to reliably prevent the agents from clogging due to air rich.

Moreover, the controller reduces the value of the certain amount M as the amount contained in the agent container lowers. Therefore, the effect according to the fifteenth aspect can be given.

Furthermore, the controller sets an initial value of the certain amount M based on an initial weight of the agent container. Therefore, it is possible to set a certain amount suitable for each container.

Moreover, the certain amount M satisfies $100\ g \geqq M \geqq 0.5$ g. Therefore, it is possible to set a certain amount optimal for each container size.

The present document incorporates by reference the entire contents of Japanese priority documents, 2001-400635 and 2001-400636 filed in Japan on Dec. 28, 2001.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image formation device comprising: a container configured to contain a developer;

an absorber configured to convey the developer to a predetermined location by negative pressure;

a conduit disposed between the container and the absorber; and a unit positionable from a first position to a second position to decrease a diameter of the conduit.

2. An image formation device comprising:

an agent container configured to contain powdery agents;

an absorber configured to convey the agents contained in the agent container to a substantially-closed, predetermined location by negative pressure;

an agent conveyance conduit forming an agent conveyance path between the agent container and the absorber;

an air supplier configured to supply air into the agent container; and an open/close unit configured to open and to close the agent conveyance conduit, wherein the open/close unit comprises an on/off valve located in the agent conveyance conduit.

3. An image formation device comprising:

an agent container configured to contain powdery agents;

an absorber configured to convey the agents contained in the agent container to a substantially-closed, predetermined location by negative pressure;

an agent conveyance conduit forming an agent conveyance path between the agent container and the absorber;

an air supplier configured to supply air into the agent container; and an open/close unit configured to open and to close the agent conveyance conduit, wherein the agent conveyance conduit comprises a flexible tube, and the open/close unit comprising a presser configured to be moved between a location to press-close the tube from an external position and a location to release the closed tube.

4. An image formation device comprising:

an agent container configured to contain powdery agents;

an absorber configured to convey the agents contained in the agent container to a substantially-closed, predetermined location by negative pressure;

an agent conveyance conduit forming an agent conveyance path between the agent container and the absorber;

an air supplier configured to supply air into the agent container; and a positive pressure generator configured to generate positive pressure in the agent conveyance conduit when the air supplier supplies the air.

5. The image formation device according to claim 4, wherein the absorber comprises a single-axial eccentric screw pump including a normally/inversely rotatable rotor configured to generate negative pressure when the rotor rotates normally, and the positive pressure generator comprises the single-axial eccentric screw pump when the rotor is configured to be driven to rotate inversely.

6. The image formation device according to claim 5, wherein the positive pressure generator is configured to generate positive pressure of pressure resistance or above that of the air supplier.

7. The image formation device according to claim 4, wherein the positive pressure generator is configured to generate positive pressure of pressure resistance or above that of the air supplier.

8. An image formation device comprising:

an agent container configured to contain toner;

an absorber configured to convey the toner contained in the agent container to a predetermined location by negative pressure;

a substantially-closed, agent conveyance path between the agent container and the absorber;

an air supplier configured to supply air into the agent container; and a controller configured to control operation of the air supplier and the absorber, the controller configured to actuate the air supplier when it is determined that a toner supplement amount by the absorber reaches a predetermined amount of at least 0.5 g.

9. The image formation device according to claim 8, wherein the absorber comprises a single-axial eccentric screw pump configured to absorbingly convey the toner by negative pressure.

10. The image formation device according to claim 8, wherein the predetermined amount is at most 10 g.

11. An image formation device comprising:

an agent container configured to contain toner;

an absorber configured to convey the toner contained in the agent container to a predetermined location by negative pressure;

a substantially-closed, agent conveyance path between the agent container and the absorber;

an air supplier configured to supply air into the agent container; and a controller configured to control operation of the air supplier and the absorber, the controller configured to actuate the air supplier when it is determined that a toner supplement amount by the absorber reaches a predetermined amount based on the toner contained in the agent container.

12. The image formation device according to claim 11, wherein the absorber comprises a single-axial eccentric screw pump configured to absorbingly convey the toner by negative pressure.

13. An image formation device comprising:

an agent container configured to contain toner;

an absorber configured to convey the toner contained in the agent container to a predetermined location by negative pressure;

a substantially-closed, agent conveyance path between the agent container and the absorber;

an air supplier configured to supply air into the agent container; and a controller configured to control operation of the air supplier and the absorber, the controller configured to actuate the air supplier when it is determined that a toner supplement amount by the absorber reaches a predetermined amount, wherein the controller is configured to vary the predetermined amount based on an amount contained in the agent container.

14. The image formation device according to claim 13, wherein the controller is configured to reduce the predetermined amount as the amount contained in the agent container is reduced.

15. The image formation device according to claim 14, wherein the controller is configured to set an initial value of the predetermined amount based on an initial weight of the agent container.

16. The image formation device according to claim 15, wherein the predetermined amount is between 0.5 g and 100 g.

17. The image formation device according to claim 13, wherein the controller is configured to set an initial value of the predetermined amount based on an initial weight of the agent container.

18. The image formation device according to claim 17, wherein the predetermined amount is between 0.5 g and 100 g.

19. An agent supplying device comprising:

a container configured to contain a developer;

an absorber configured to convey the developer to a predetermined location by negative pressure;

a conduit disposed between the container and the absorber; and a unit positionable from a first position to a second position to decrease a diameter of the conduit.

20. An agent supplying device comprising:

an agent container configured to contain powdery agents;

an absorber configured to convey the agents contained in the agent container to a substantially-closed, predetermined location by negative pressure;

an agent conveyance conduit forming an agent conveyance path between the agent container and the absorber;

an air supplier configured to supply air into the agent container; and a positive pressure generator configured to generate positive pressure in the agent conveyance conduit when the air supplier supplies the air.

21. An agent supplying device comprising:

an agent container configured to contain powdery agents;

an absorber configured to convey the agents contained in the agent container to a predetermined location by negative pressure;

a substantially-closed, agent conveyance path between the agent container and the absorber;

an air supplier configured to supply air into the agent container; and a controller configured to control operations of the air supplier and the absorber, the controller configured to actuate the air supplier when it is determined that an agent supplement amount by the absorber reaches a predetermined amount of at least 0.5 g.

22. The agent supplying device according to claim 21, wherein the absorber comprises a single-axial eccentric screw pump configured to absorbingly convey the agents by negative pressure.

23. The agent supplying device according to claim 21, wherein the predetermined amount is at most 10 g.

24. An agent supplying device comprising:

an agent container configured to contain powdery agents;

an absorber configured to convey the agents contained in the agent container to a predetermined location by negative pressure;

a substantially-closed, agent conveyance path between the agent container and the absorber;

an air supplier configured to supply air into the agent container; and a controller configured to control operation of the air supplier and the absorber, the controller configured to actuate the air supplier when it is determined that an agent supplement amount by the absorber reaches a predetermined amount based on an amount contained in the agent container.

25. The agent supplying device according to claim 24, wherein the absorber comprises a single-axial eccentric screw pump configured to absorbingly convey the agents by negative pressure.

26. An agent supplying device comprising:

an agent container configured to contain powdery agents;

an absorber configured to convey the agents contained in the agent container to a predetermined location by negative pressure;

a substantially-closed, agent conveyance path between the agent container and the absorber;

an air supplier configured to supply air into the agent container; and a controller configured to control operation of the air supplier and the absorber, the controller configured to actuate the air supplier when it is determined that an agent supplement amount by the absorber reaches a predetermined amount based on an amount contained in the agent container.

27. The agent supplying device according to claim 26, wherein the controller is configured to reduce the predetermined amount as the amount contained in the agent container decreases.

28. The agent supplying device according to claim 27, wherein the controller is configured to set an initial value of the predetermined amount based on an initial weight of the agent container.

29. The agent supplying device according to claim 28, wherein the predetermined amount is between 0.5 g and 100 g.

30. The agent supplying device according to claim 26, wherein the controller is configured to set an initial value of the predetermined amount based on an initial weight of the agent container.

31. The agent supplying device according to claim 30, wherein the predetermined amount is between 0.5 g and 100 g.

* * * * *